United States Patent [19]

Amelio

[11] 3,992,025

[45] Nov. 16, 1976

[54] SKATE BOARD AND WHEELS THEREFOR

[75] Inventor: Joseph G. Amelio, Reseda, Calif.

[73] Assignee: Union Plastics West, North Hollywood, Calif.

[22] Filed: Nov. 17, 1975

[21] Appl. No.: 632,356

[52] U.S. Cl. ..... 280/87.04 A; 301/5.7

[51] Int. Cl.[2] ..... A63C 17/22

[58] Field of Search ..... 280/87.04 A, 11.28, 280/11.27, 11.1 R, 11.1 BT, 11.19; 301/5 R, 5.3, 5.7; 308/190, 191; D34/15 AJ, 14 C

[56] References Cited

UNITED STATES PATENTS

| | | | |
|---|---|---|---|
| 884,720 | 4/1908 | Curtis | 301/5.7 |
| 2,105,354 | 1/1938 | Hoerle | 301/5.7 |
| 2,871,061 | 1/1959 | Behm et al. | 301/5.3 |
| 3,043,631 | 7/1962 | Swoboda | 301/6 |
| 3,360,314 | 12/1967 | Di Loreto | 301/5.7 |
| 3,362,722 | 1/1968 | Core | 280/87.04 |
| 3,895,844 | 7/1975 | Merbler | 301/5.7 |
| 3,905,649 | 9/1975 | Kosono et al. | 301/5.7 |
| D200,917 | 4/1965 | Markham | 280/87.04 A |

FOREIGN PATENTS OR APPLICATIONS

| | | | |
|---|---|---|---|
| 959,494 | 6/1964 | United Kingdom | 301/5.7 |

*Primary Examiner*—M. H. Wood, Jr.
*Assistant Examiner*—David M. Mitchell
*Attorney, Agent, or Firm*—Steinberg and Blake

[57] ABSTRACT

A skateboard wheel includes a roller body consisting of a solid piece of resilient plastic formed with cooling bores passing therethrough. At one end region the roller body is formed with an enlarged recess with which the cooling bores communicate. In this recess the roller body has reinforcing fins intergral with the roller body, situated in planes which contain the axis of the roller body, and distributed about this axis.

16 Claims, 4 Drawing Figures

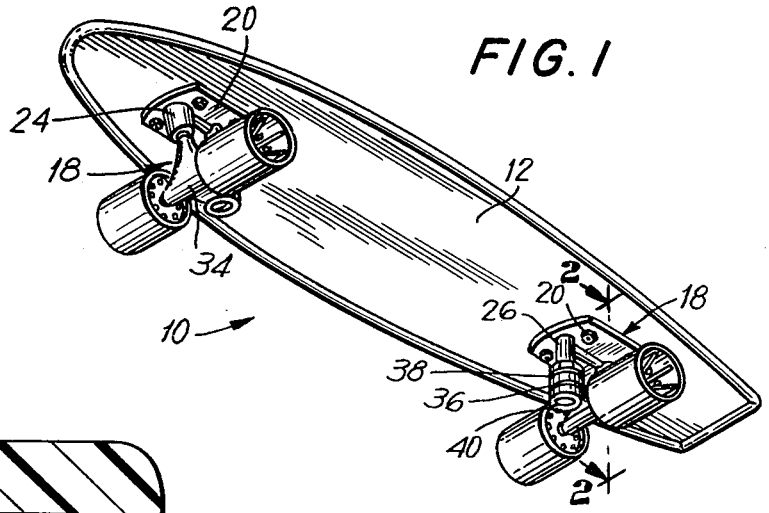
FIG. 1
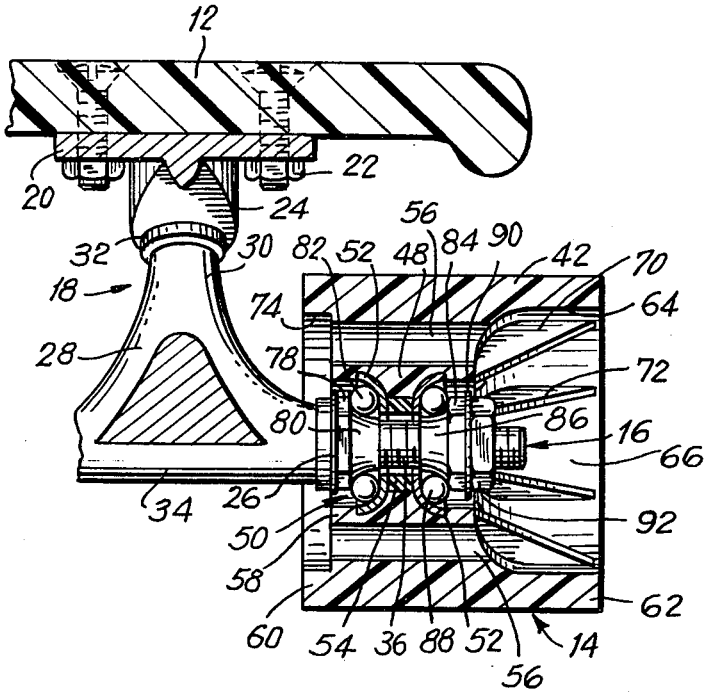
FIG. 2
FIG. 3
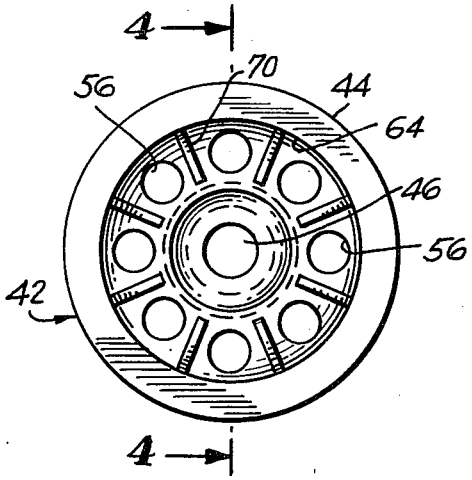
FIG. 4
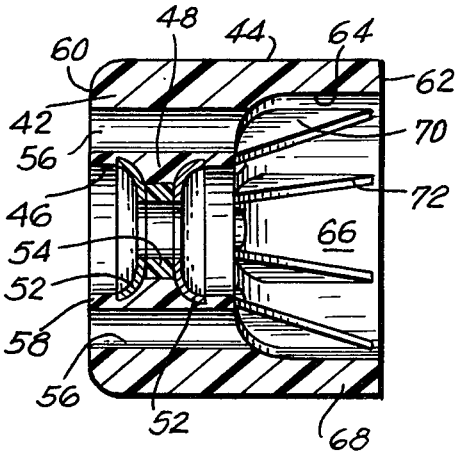

SKATE BOARD AND WHEELS THEREFOR

BACKGROUND OF THE INVENTION

The present invention relates to skateboards and especially to roller assemblies particularly designed for use in skateboards.

As is well known, skateboards are in effect a single relatively large roller skate having a board on which the operator stands while rollers which support the board permit the latter to travel with the operator thereon. Such skateboards form a source of considerable pleasure to the users thereof while at the same time being a source of a sporting activity which requires considerable physical skill. Such physical skill particularly comes into play when executing turns with the skateboard. With conventional skateboards it is difficult to execute sharp turns of small radius. The execution of such turns creates considerable wear at the rollers of the skateboard, and considerable slippage takes place between the rollers and the surface on which they roll during execution of turns, creating not only undesirable wear of the rollers but in addition creating unsafe conditions for the operator of the skateboard.

SUMMARY OF THE INVENTION

It is accordingly a primary object of the present invention to provide for a skateboard a roller structure which is vastly superior to previously known roller structures designed for the same purpose.

In particular, it is an object of the invention to provide a roller structure, particularly for skateboards, which will have the capability of enabling a skateboard operator to execute turns in a manner which is far safer than has heretofore been possible while at the same time reducing slippage between the rollers and the surface on which they roll and increasing the life of the rollers as compared to conventional rollers.

It is especially an object of the present invention to provide for a skateboard or the like rollers which are capable of increasing their traction with respect to the surface on which they roll when executing turns.

An additional object of the present invention is to provide a roller construction which during operation is capable of being effectively cooled in order to increase the life of the roller construction.

Also, the object of the present invention include the provision of a skateboard and a roller construction to be used therewith which while being of relatively low cost nevertheless are capable of achieving the above objects in a highly reliable manner.

According to the invention the roller construction which is adapted to be used in a skateboard includes a roller body consisting of a resilient plastic material, preferably polyurethane, this roller body having an exterior cylindrical surface of circular cross section which surrounds a central axis of the roller body. Along its central axis the roller body is formed with a central bore next to which is situated an inner hub portion adapted to be fixed with at least part of a bearing means which supports the roller body for rotary movement about its central axis. Between the central bore and its exterior cylindrical surface the roller body is formed with a plurality of cooling bores which extend parallel to the central axis of the roller body, through the latter, while being circumferentially distributed about this central axis. The central and cooling bores of the roller body are formed in an inner transverse portion of the roller body which is situated closer to one end than an opposed other end of the roller body, and at this latter other end the roller body is formed with an enlarged recess having next to this other end an inner cylindrical surface coaxially surrounding the central axis of the roller body and situated radially outwardly beyond the cooling bores. Between this inner cylindrical surface and its exterior cylindrical surface the roller body has a flexible wall portion capable of flexing particularly when the roller travels along a curved path so as to increase the area of contact between the roller and the surface on which it rolls, thus affording a greater traction while at the same time increasing the safety of a skateboard which includes the roller construction.

BRIEF DESCRIPTION OF DRAWINGS

The invention is illustrated by way of example in the accompanying drawings which form part of this application and in which:

FIG. 1 is a perspective illustration of a skateboard of the invention as seen when looking toward the lower, downwardly directed surface of the board which carries the operator, so as to clearly illustrate the roller structure carried by the board;

FIG. 2 is a fragmentary transverse section taken along line 2—2 of FIG. 1 in the direction of the arrows and showing more details than FIG. 1 at a scale which is enlarged as compared to FIG. 1;

FIG. 3 is an end view of the roller of FIG. 2 as seen from the right of FIG. 2, FIG. 3 illustrating only the roller itself and part of the bearing means which is fixed with the roller; and FIG. 4 is a longitudinal sectional elevation of the structure of FIG. 3 taken along line 4—4 of FIG. 3 in the direction of the arrows.

DESCRIPTION OF PREFERRED EMBODIMENTS

Referring now to the drawings, there is shown in FIG. 1 a skateboard 10 having the structure of the present invention. The skateboard 10 includes an upper elongated board 12 the lower surface of which is visible in FIG. 1. The board 12 may be made of a plastic material or it may be made of metal or wood, as desired. Situated beneath and spaced from the board 12 of the skateboard 10 are four rollers 14 one of which is shown in detail in FIGS. 2–4. The rollers 14 are supported on shafts 16 one of which is partly illustrated in FIG. 2, and these shafts 16 are connected with the board 12 by way of a pair of connecting means 18.

Each connecting means 18 includes a metal plate 20 fixed to the lower surface of the board 12 by way of fastener assemblies 22. These fastener assemblies 22 include bolts the heads of which are countersunk into recesses in the top surface of the board 12, and the bolts pass through openings in the plates 20 and carry nuts engaging the lower surfaces of the plates 20 so that the latter are rigidly fixed with the board 12.

Each metal plate 20 of each connecting means 18 has integrally formed therewith a downwardly extending tubular extension 24, situated adjacent one end of the plate 20 and a second downwardly extending tubular extension 26 situated at the other end of the plate 20. The rear plate 20 shown at the right in FIG. 1 is oriented in a reverse manner with respect to the front plate 20 shown at the left of FIG. 1, so that the tubular extensions 24 and 26 are reversely oriented at the pair of plates 20.

Each connecting means 18 further includes a shaft-carrying member 28 having an extension 30 received in the tubular extension 24 with a rubber sleeve 32 which extends into the tubular extension 24 surrounding the part of the extension 30 which also extends into the tubular extension 24. The member 28 has a tubular portion 34 formed with a bore passing therethrough transversely with respect to the bore 12 and receiving the shaft 16. The length of the tubular portion 34 of member 28 of the connecting means 18 is such that the shaft 16 has elongated free portions extending freely beyond the tubular portion 34. Thus, FIG. 2 shows one of the elongated free portions 36 of the illustrated shaft 16 extending to the right freely beyond the tubular portion 34 in FIG. 2. At the side of the tubular portion 34 opposite from the tubular extension 30 each member 28 has a lug 36 situated between a pair of rubber washers 38 shown for the right connecting means 18 in FIG. 1, and through an opening of the lug 36 as well as through the rubber washers 38 extends a fastener bolt 40 which passes through additional metal washers and is threaded into the tubular extension 26 at an internal thread thereof so that in this way the member 28 is fixed with the plate 20 of the connecting means 18.

As is indicated in FIG. 2, each free portion 36 of each shaft 16 extends through a central bore of a roller body 42 of each roller 14. The roller body 42 is made of a suitable flexible resilient plastic, and preferably is made of polyurethane. While this latter material is preferred for the roller body 42, of course a number of other plastics can be used such as, for example, polystyrene, high impact styrene, cellulose acetate, polyvinyl chloride, nylon, polypropylene, polyethylene, etc.

Each roller body 42 has an exterior cylindrical surface 44 which is of circular cross section, as shown most clearly in FIG. 3. This exterior cylindrical surface 44 surrounds an elongated central axis of the roller body, and a central bore 46 passes through the roller body 44 with the axis of the central bore 46 coinciding with the axis of the surface 44.

Adjacent the central bore 46 the roller body 44 is formed with an inner hub portion 48 fixed with part of a bearing means 50 the details of which are shown in FIG. 2. As is apparent from FIG. 4, the part of the bearing means which is fixed to the hub 48 includes a pair of bearing races 52 which are of circular configuration and which have inner concave surfaces surrounding the central axis of the body 42. Between the races 52 is a circular spacer ring 54 made of any suitable plastic. When the body 42 is molded, the races 52 and spacer 54 are positioned centrally within the mold on a suitable core member, and the body 42 is molded directly onto the bearing races 52 and the spacer 54 so that in this way these components are fixed with the body 42.

In addition, the body 42 is formed with a plurality of cooling bores 56 which pass through the body 42 and which are situated between the central bore 46 and the exterior cylindrical surface 44, these cooling bores 56 being circumferentially distributed uniformly about the central axis of the body 44, as is apparent from FIG. 3.

The body 42 has a transverse inner portion 58 which is formed with the central bore 46 and the cooling bores 56, the latter cooling bores 56 being formed in the body 42 when the latter is molded by utilizing suitable removable core members in the mold. As is apparent from FIGS. 2 and 4, the transverse inner portion 58 of the body 42 is situated closer to one end than the other opposed end of the body 42. Thus in FIGS. 2 and 4 the transverse inner portion 58 is situated closer to the left end 60 than the right end 62 of the body 42.

The body 42 furthermore is formed with an enlarged recess 64 extending inwardly from its end 62 which is more distant from the transverse portion 58, this enlarged recess 64 extending from the end 62 up to the transverse portion 58. This recess 64 is defined adjacent the end 62 by an inner cylindrical surface 66 which is coaxial with the exterior cylindrical surface 44 and which defines therewith an elongated cylindrical wall portion 68 projecting beyond the transverse portion 58.

Within the recess 64 the body 42 has integral reinforcing fins 70 which are molded at the same time that the remainder of the body 42 is molded. These reinforcing fins 70 have free elongated inclined edges 72 the outer ends of which are adjacent the end 62 of the body 42 while the inner ends of the edges 72 are adjacent the central bore 46. The reinforcing fins 70 are respectively situated in radial planes which contain the central axis of the body 42, as is apparent from FIG. 3. It will be noted that the cylindrical surface 66 of the enlarged recess 64 is situated radially outwardly beyond the cooling bores 56, and the same is true of the outer ends of the edges 72 of the reinforcing fins 70. On the other hand the inner ends of these edges 72 are situated closer to the central axis of the body 42 than the axes of the cooling bores 56. Thus, as is most clearly apparent from FIG. 3, the cooling bores 56 and the reinforcing fins 70 circumferentially alternate with respect to each other around the central axis of the roller body 42 with the cooling bores 56 being situated between the radial planes which contain the reinforcing fins 70. While in FIGS. 3 and 4 the roller body 42 has its left end 60 flush with the left ends of the central bore 46 and cooling bores 56, in FIG. 2 the body 42 is formed at its left end 60 with a relatively shallow recess 74 the inner surface of which forms the left end surface of the transverse portion 58 while the opposite end surface of transverse portion 58 forms the inner end of the enlarged recess 64.

Each free portion 36 of each shaft 16 is surrounded next to an end of a tubular portion 34 of connecting means 18 by a washer 76, and each portion 36 of each shaft 16 is threaded so as to be capable of being threaded through a hexagonal nut member 78 which has a tapered concavely curved annular portion 80 forming a bearing race which cooperates with the left bearing race 52, as viewed in FIGS. 2 and 4. Between the race 80 and the left bearing race 52 are situated a plurality of ball bearing members 82. In a similar manner the portion 36 of shaft 16 has at each roller body 42 a hexagonal nut member 84 threaded onto the portion 36 of each shaft 16 and having a tapered concavely curved annular portion 86 forming a bearing race to cooperate with the other bearing race 52 with a plurality of ball bearing members 88 being situated at the outer bearing of the bearing means 50. A further washer 90 is situated next to the member 84 and a lock nut 92 is threaded onto the free portion 36 of each shaft 16 so as to fix the entire bearing assembly on each shaft end 36 in the manner shown in FIG. 2.

Thus, by way of the above construction it is possible for each roller body 42 to be supported by a bearing means 50 for free rotation with respect to a shaft 16 which is fixedly carried by the connecting means 18 which in turn is connected with the board 12.

Because the roller bodies 42 are made of a plastic resilient material as described above, they operate in a very quiet manner and provide an extremely smooth ride. Excessive heating is avoided by way of the cooling bores 56 which during rotation of the roller bodies provide for flow of cooling air through the roller bodies. This flow of cooling air is enhanced by the fins 70 which create a whirling air flow which serves to draw air through the cooling bore 56 and thus achieve an effective cooling which greatly lengthens the operating life of the roller bodies 42. In addition the cooling bores 56 reduce the weight of the roller bodies 42 and increase the extent of yieldability thereof.

In this latter connection it is to be noted that when a roller body 42 travels along the curved path with the end 62 thereof situated along the inside of the curved path, the wall 68 defined between the cylindrical surface 66 and the cylindrical surface 44 is capable of flexing, becoming flattened against the surface along which the roller travels under these conditions. Thus under these particular conditions the bottom of the roller which at any given instant engages the surface along which the roller travels does not have a pure line contact. Instead this contact has a substantial area which becomes gradually wider toward the end 62 thus providing a reduction in slippage and an increased traction affording an extremely safe and effective maneuverability when executing turns while greatly increasing the safety of the skateboard, inasmuch as an operator can execute with the skateboard of the invention in a completely safe manner a turn having a radius much smaller than has heretofore been possible.

The reinforcing fins 70 in addition to enhancing the cooling action also serve to reinforce the flexible circular wall portion 68 so that even though the latter can flex as described above nevertheless the roller has a strong construction and a long operating life.

What is claimed is:

1. For use in a device such as a skateboard, a roller body consisting of a solid piece of resilient plastic material and having opposed ends and extending between said ends an exterior cylindrical surface of circular cross section surrounding a central axis of the roller body, the latter being formed with a central axial bore passing through said body and having an axis coinciding with said central axis, said body having adjacent said bore an interior hub portion, and said body being formed between said central bore and said exterior cylindrical surface with a plurality of cooling bores passing through said body and extending parallel to said central axis thereof as well as being distributed about said axis, and at least part of a bearing means fixed to said hub portion at an inner surface thereof which defines part of said central bore for participating in the support of said roller body for rotation about said central axis thereof.

2. The combination of claim 1 and wherein said roller body has inwardly of said exterior cylindrical surface thereof a transverse portion formed with said central and cooling bores and situated with said hub portion and bearing means part fixed thereto closer to one of said ends than the other of said ends of said roller body, the latter being formed with an enlarged recess extending from said transverse portion to said other end of said roller body and said roller body having an inner cylindrical surface extending from said other end of said roller body toward said transverse portion thereof and defining that part of said enlarged recess which is adjacent said other end of said roller body, said inner cylindrical surface being situated radially outwardly beyond said cooling bores with the latter opening into said enlarged recess, said roller body having between said inner and exterior cylindrical surfaces thereof and extending inwardly from said other end a circular wall portion situated in its entirety beyond said hub portion and bearing means part carried thereby and capable of resiliently flexing to improve the traction of the roller body particularly when the latter travels along a curved path.

3. For use in a device such as a skateboard, a roller body consisting of a resilient plastic material and having opposed ends and extending between said ends an exterior cylindrical surface of circular cross section surrounding a central axis of the roller body, the latter being formed with a central axial bore passing through said body and having an axis coinciding with said central axis, said body having adjacent said bore an interior hub portion, and said body being formed between said central bore and said exterior cylindrical surface with a plurality of cooling bores passing through said body and extending parallel to said central axis thereof as well as being distributed about said axis, and at least part of a bearing means fixed to said hub portion at an inner surface thereof which defines part of said central bore for participating in the support of said roller body for rotation about said central axis thereof, said roller body having inwardly of said exterior cylindrical surface thereof a transverse portion formed with said central and cooling bores and situated closer to one of said ends than the other of said ends of said roller body, the latter being formed with an enlarged recess extending from said transverse portion to said other end of said roller body and said roller body having an inner cylindrical surface extending from said other end of said roller body toward said transverse portion thereof and defining that part of said enlarged recess which is adjacent said other end of said roller body, said inner cylindrical surface being situated radially outwardly beyond said cooling bores with the latter opening into said enlarged recess, said roller body having between said inner and exterior cylindrical surfaces thereof and extending inwardly from said other end a circular wall portion capable of resiliently flexing to improve the traction of the roller body particularly when the latter travels along a curved path, said roller body having in said enlarged recess thereof a plurality of reinforcing fins integral with the remainder of said roller body, respectively situated in radial planes which contain said central axis, and distributed about said axis.

4. The combination of claim 3 and wherein said fins respectively have inner free inclined edges each having an outer end adjacent said other end of said roller body and an inner end adjacent said central bore of said roller body.

5. The combination of claim 4 and wherein said fins respectively alternate circumferentially with said cooling bores with said inner ends of said free edges of said fins situated closer to said central axis than said cooling bores while said outer ends of said free edges of said fins are situated more distant from said central axis than said cooling bores so that the latter are respectively situated between the radial planes in which said fins are respectively situated.

6. The combination of claim 5 and wherein said fins and cooling bores are uniformly distributed about said central axis.

7. The combination of claim 6 and wherein said roller body has at said opposed ends thereof flat annular surfaces respectively situated in planes normal to said central axis.

8. The combination of claim 7 and wherein said roller body has at said one end thereof a shallow recess having an inner surface defining one end surface of said transverse portion of said roller body while an opposed end surface of said transverse portion of said roller body is defined by an inner surface of said enlarged recess thereof.

9. The combination of claim 1 and wherein said roller body is made of polyurethane.

10. The combination of claim 1 and wherein said part of said bearing means which is fixed with said roller body at said hub portion thereof includes a pair of opposed bearing races coaxially surrounding said central axis and fixed to said roller body at an inner surface thereof which defines said central bore.

11. The combination of claim 10 and wherein said bearing races respectively have circular concave bearing surfaces directed away from each other.

12. The combination of claim 11 and wherein said roller body carries in said bore thereof a circular spacer situated between and engaging said bearing races.

13. The combination of claim 11 and wherein a shaft extends coaxially through said central bore inwardly of and out of engagement with said roller body and said pair of bearing races, the latter forming a pair of inner bearing races of a pair of roller bearings of said bearing means, and said shaft carrying a pair of outer races and said bearing means, the latter outer races respectively cooperating with said pair of inner races, and a plurality of ball bearing members situated between each inner bearing race and outer bearing race cooperating therewith, so that said roller body is supported for free rotation on said shaft.

14. The combination of claim 13 and including a board and connecting means connecting said shaft to said board.

15. The combination of claim 14 and wherein said board carries a pair of said connecting means and said pair of connecting means respectively carrying a pair of said shafts, each of said shafts having an elongated free portion extending beyond each connecting means and each of said elongated free shaft portions carrying said bearing means and a roller body supported for free rotation by said bearing means.

16. For use in a device such as a skateboard, a roller body consisting of a resilient plastic material and having opposed ends and extending between said ends an exterior cylindrical surface of circular cross section surrounding a central axis of the roller body, the latter being formed with a central axial bore passing through said body and having an axis coinciding with said central axis, said body having adjacent said bore an interior hub portion, and said body being formed between said central bore and said exterior cylindrical surface with a plurality of cooling bores passing through said body and extending parallel to said central axis thereof as well as being distributed about said axis, and at least part of a bearing means fixed to said hub portion at an inner surface thereof which defines part of said central bore for participating in the support of said roller body for rotation about said central axis thereof, said roller body having inwardly of said exterior cylindrical surface thereof a transverse portion formed with said central and cooling bores and situated between said ends of said roller body, the latter being formed with an enlarged recess extending from said transverse portion to one of said ends of said roller body and said roller body having an inner cylindrical surface extending from said one end of said roller body toward said transverse portion thereof and defining that part of said enlarged recess which is adjacent said one end of said roller body, said inner cylindrical surface being situated radially outwardly beyond said cooling bores with the latter opening into said enlarged recess, and said roller body having in said enlarged recess thereof a plurality of reinforcing fins integral with the remainder of said roller body, respectively situated in radial planes which contain said central axis, and distributed about said axis.

* * * * *